US010030551B2

(12) United States Patent
Ferraris et al.

(10) Patent No.: US 10,030,551 B2
(45) Date of Patent: Jul. 24, 2018

(54) COOLING SYSTEM FOR AN INTERNAL COMBUSTION ENGINE OF A MOTOR VEHICLE

(71) Applicant: C.R.F. Societa Consortile per Azioni, Orbassano (Turin) (IT)

(72) Inventors: Walter Ferraris, Orbassano (IT); Federica Bettoja, Orbassano (IT)

(73) Assignee: C.R.F. Societa Consortile per Azioni, Orbassano (Turin) (IT)

( * ) Notice: Subject to any disclaimer, the term of this patent is extended or adjusted under 35 U.S.C. 154(b) by 0 days.

(21) Appl. No.: 15/438,808

(22) Filed: Feb. 22, 2017

(65) Prior Publication Data

US 2017/0328246 A1 Nov. 16, 2017

(30) Foreign Application Priority Data

May 16, 2016 (EP) ..... 16169784

(51) Int. Cl.
*F01M 5/02* (2006.01)
*F01P 7/14* (2006.01)
(Continued)

(52) U.S. Cl.
CPC ..... *F01M 5/021* (2013.01); *F01M 5/002* (2013.01); *F01P 7/14* (2013.01); *F01P 11/08* (2013.01);
(Continued)

(58) Field of Classification Search
CPC .. F01P 7/165; F01P 2007/146; F01P 2037/02; F01P 2037/00; F01P 2060/00; F01P 7/00; F02D 41/064; F02D 41/068
See application file for complete search history.

(56) References Cited

U.S. PATENT DOCUMENTS 2,401,510 A 6/1946 Rowley
4,627,397 A * 12/1986 Hayashi ..... F01M 5/002 123/41.27
(Continued)

FOREIGN PATENT DOCUMENTS

DE 19608748 A1 9/1996
DE 19737818 A1 3/1998
(Continued)

OTHER PUBLICATIONS

European Search Report for European Application No. 16169784.2 dated Sep. 21, 2016, 5 pages.

*Primary Examiner* — Long T Tran
(74) *Attorney, Agent, or Firm* — RMCK Law Group PLC

(57) ABSTRACT

In a vehicle cooling system, a quantity of warm coolant stored within a thermally insulated tank is used to heat engine lubricating oil in an engine warm-up phase following a cold start. A conduit feeding coolant leaving the engine is connected to an inlet of the tank via a reduced cross-section or a labyrinth pathway. The conduit is connected to an inlet of an electronically controlled distribution valve having three outlets connected to the oil cooler, a passenger compartment heater, and a radiator. In an initial part of the warm-up phase, the valve is closed, and the entire flow of coolant leaving the engine flows into the tank, moving the quantity of warm coolant previously stored in the tank to the oil cooler, where it contributes to more rapid heating of the lubricating oil. When the engine is switched-off, the tank is again filled with warm coolant from the engine.

14 Claims, 2 Drawing Sheets

Figure 1:
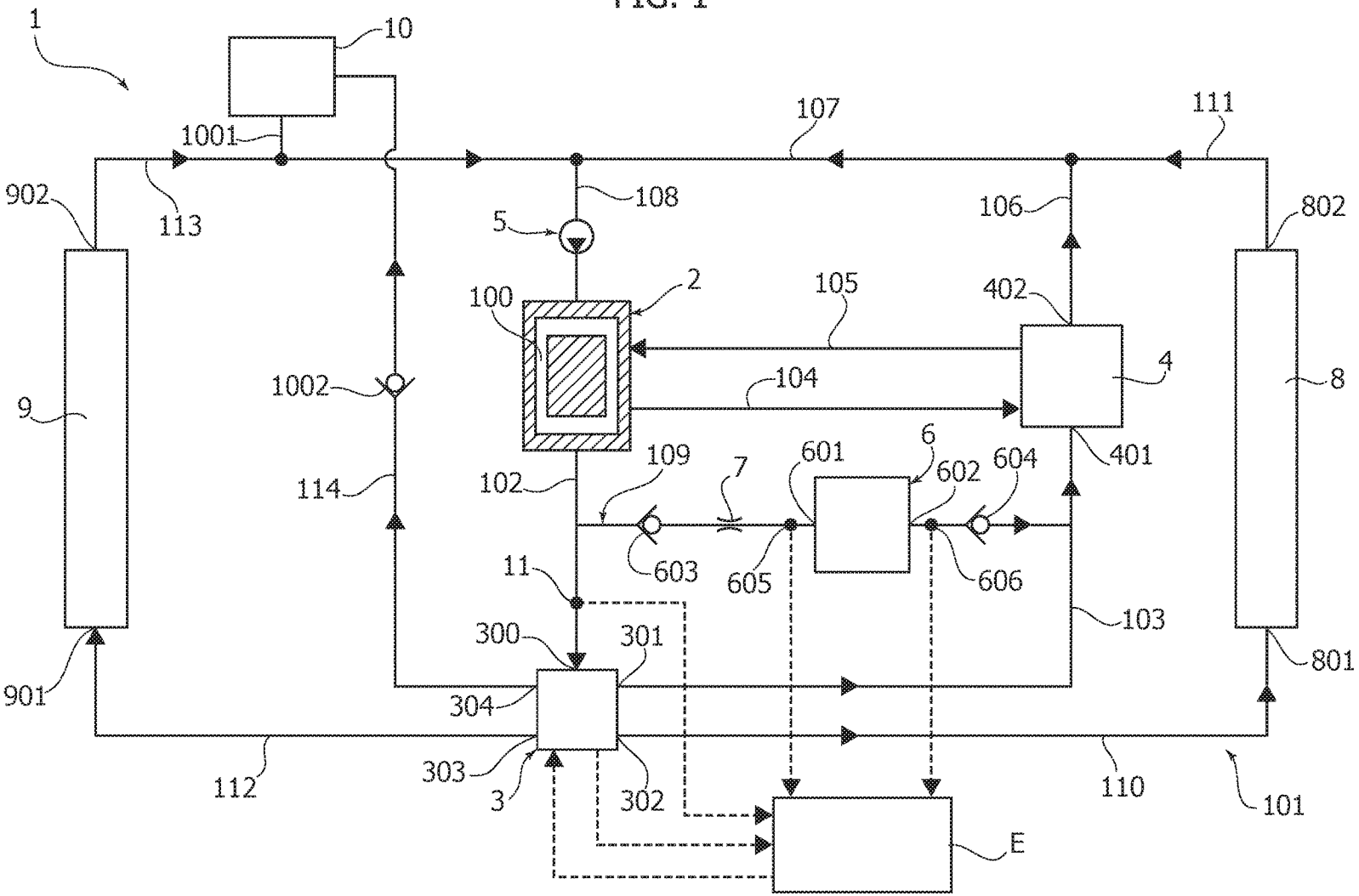

(51) Int. Cl.
*F01P 11/08* (2006.01)
*F01M 5/00* (2006.01)

(52) U.S. Cl.
CPC ..... *F01P 2007/146* (2013.01); *F01P 2037/00* (2013.01); *F01P 2060/00* (2013.01)

(56) References Cited

U.S. PATENT DOCUMENTS

| | | | | |
|---|---|---|---|---|
| 5,299,630 | A | 4/1994 | Schatz | |
| 5,730,089 | A | 3/1998 | Morikawa et al. | |
| 5,896,833 | A | 4/1999 | Aoki | |
| 6,520,136 | B2 * | 2/2003 | Ito | F02N 19/10 123/142.5 R |
| 7,124,715 | B2 * | 10/2006 | Hutchins | B60H 1/00314 123/41.1 |
| 7,533,636 | B2 * | 5/2009 | Marsh | F01M 5/002 123/196 AB |
| 9,004,020 | B2 * | 4/2015 | Mehring | F01M 5/001 123/41.01 |
| 2002/0029755 | A1 * | 3/2002 | Ito | F02N 19/10 123/142.5 R |
| 2004/0216700 | A1 * | 11/2004 | Hutchins | B60H 1/00314 123/41.08 |
| 2005/0229873 | A1 | 10/2005 | Willers | |
| 2008/0264359 | A1 * | 10/2008 | Marsh | F01M 5/002 123/41.33 |

FOREIGN PATENT DOCUMENTS

| | | | |
|---|---|---|---|
| JP | 3843499 | B2 | 3/1998 |
| JP | H10309933 | A | 11/1998 |
| JP | 2002266679 | A | 9/2002 |
| JP | 3353236 | B2 | 12/2002 |
| JP | 2003322019 | A | 11/2003 |
| JP | 2008082225 | A | 4/2008 |
| JP | 5189461 | B2 | 4/2013 |
| WO | 2007113419 | A1 | 10/2007 |

* cited by examiner

COOLING SYSTEM FOR AN INTERNAL COMBUSTION ENGINE OF A MOTOR VEHICLE

CROSS REFERENCE TO RELATED APPLICATIONS

This application claims priority to European Patent Application No. 16169784.2 filed on May 16, 2016, the entire disclosure of which is incorporated herein by reference.

FIELD OF THE INVENTION

The present invention relates to cooling systems for motor-vehicle internal combustion engines of the type comprising:

- a circuit for an engine coolant, including an inner circuit portion internal to the engine and an outer circuit portion external to the engine,
- a thermally insulated tank for the engine coolant, connected to said outer portion of the cooling circuit and adapted to maintain a determined quantity of coolant at a temperature higher than the ambient temperature when the engine is inactive, so as to enable said quantity of coolant at a temperature higher than ambient temperature to be used after a subsequent start of the engine, during an engine warm-up phase, said outer circuit portion further including:

- a pump to activate circulation of the coolant in the circuit,
- an oil cooler for cooling the engine lubricating oil,
- a heater for heating the passenger compartment,
- a radiator for cooling the coolant,
- an electronically controlled distribution valve to control the flow of coolant in the outer circuit portion, so as to direct this flow towards the lubricating oil cooler and/or towards the passenger compartment heater and/or towards the radiator, and
- an electronic control unit to control the operating condition of said electronically controlled distribution valve as a function of one or more operating parameters including at least one detected value of the coolant temperature,
- wherein said electronically controlled distribution valve has an inlet connected to a first conduit supplying the coolant coming out from the engine.

PRIOR ART

In cooling systems of the above indicated type, the aforesaid thermally insulated tank is used to accelerate engine warm-up phase after a cold start, due to the possibility of using the relatively warm coolant contained therein. Systems of this type are known, for example, from documents US 2005/229873, U.S. Pat. No. 5,299,630, U.S. Pat. No. 2,401,510, JP 3353236, JP 5189461, JP 2002266679, JP 2003 322019, JP H10 309933, JP 3843499 and JP 2008 082225.

OBJECT OF THE INVENTION

The object of the present invention is to provide a cooling system of the above indicated type in which the warm-up phase after a cold start of the engine is accelerated and in which furthermore an operating condition of the engine allowing minimal fuel consumption is achieved in the shortest possible time.

SUMMARY OF THE INVENTION

In order to achieve the above object, the present invention deals with a cooling system for an internal combustion engine of a motor vehicle having all the features indicated in the beginning of the present specification and further characterized in that:

- said thermally insulated tank is placed in a second conduit connecting said first conduit to an inlet of said engine lubricating oil cooler,
- said electronically controlled distribution valve comprises:
- a first outlet connected to said inlet of the engine lubricating oil cooler,
- a second outlet connected to an inlet of said passenger compartment heater, and
- a third outlet connected to an inlet of said radiator,
- said electronically controlled distribution valve being selectively switchable to one of the following operating conditions:
- a closed condition, in which all of said first, second and third outlets are isolated with respect to said inlet of the valve,
- a first opened condition, in which only said first outlet communicates with the inlet of the valve,
- a second opened condition, in which only said first and second outlets communicate with the inlet of the valve, and
- a third opened condition, in which all said first, second and third outlets communicate with said inlet of the valve,
- said electronic control unit being programmed so that, after the internal combustion engine is started, the following operating phases are actuated in sequence, as the detected temperature of the engine coolant increases:
- a first phase in which the electronically controlled distribution valve is maintained in its closed condition, so that the coolant leaving the engine flows entirely from said first conduit to said second conduit, causing the quantity of coolant previously stored within the thermally insulated tank to be fed to the engine lubricating oil cooler,
- a second phase in which the electronically controlled distribution valve is maintained in its first opened condition, so that the coolant leaving the engine is still fed solely to the engine lubricating oil cooler,
- a third phase in which the electronically controlled distribution valve is maintained in its second opened condition, so that the coolant leaving the engine is fed both to the engine lubricating oil cooler and to the passenger compartment heater, and
- a fourth phase in which the electronically controlled distribution valve is maintained in its third opened condition, so that the coolant leaving the engine is fed both to the engine lubricating oil cooler and to the passenger compartment heater and to the radiator.

Due to the above described arrangement, the system according to the invention is therefore able to give a priority to the engine lubricating oil cooler in the initial phase of engine warm-up, after a cold start. In this phase, the heat exchanger constituting the lubricating oil cooler is used to heat the lubricating oil in order to bring it up to an ideal temperature to guarantee minimum frictions in the engine and consequently minimum fuel consumption, in the shortest possible time.

According to another characteristic of the invention, the inlet of said thermally insulated tank communicates with said first conduit through a passage of restricted cross-section and/or a labyrinth pathway, so that when the electronically controlled distribution valve is in one of its opened conditions the coolant leaving the engine tends to flow toward the outlets of the valve, rather than towards said thermally insulated tank.

Thanks to this characteristic, the system according to the invention can be provided with no intercepting valve in the communication of the inlet of the thermally insulated tank with the first conduit feeding the coolant from the engine.

In one sample embodiment of the cooling system according to the invention, two temperature sensors are provided in said second conduit, respectively arranged upstream and downstream of the thermally insulated tank, and the electronic control unit is configured to receive the output signals from said sensors and to command switching from said first operating phase to said second operating phase when the temperature values detected by said sensors become substantially identical. This condition in fact indicates that in the first phase following starting of the engine the warm coolant previously stored in the thermally insulated tank has completely left the tank to flow towards the engine lubricating oil cooler, while the tank continues to receive the flow of coolant leaving the engine, so that the temperature of the coolant at the inlet of the tank becomes substantially identical to the temperature of the coolant at the outlet of the tank.

Again in the case of the preferred sample embodiment, switching from said second operating phase to said third operating phase is triggered by the electronic control unit when the detected value of the coolant temperature exceeds a first threshold value, while switching from the third operating phase to the fourth operating phase is triggered by said electronic control unit when the detected value of the coolant temperature exceeds a second threshold value, greater than said first threshold value. Naturally, switching from one operating condition to the next is implemented only when the respective thermal condition has been achieved. As an indicator parameter to be used for switching of the various operating phases of the system, one can use, instead of, or in addition to, the detected value of the coolant temperature, any other suitable parameter, such as the temperature of the engine lubricating oil or the temperature of the metal body of the engine.

DESCRIPTION OF ONE EMBODIMENT

Figure 2:
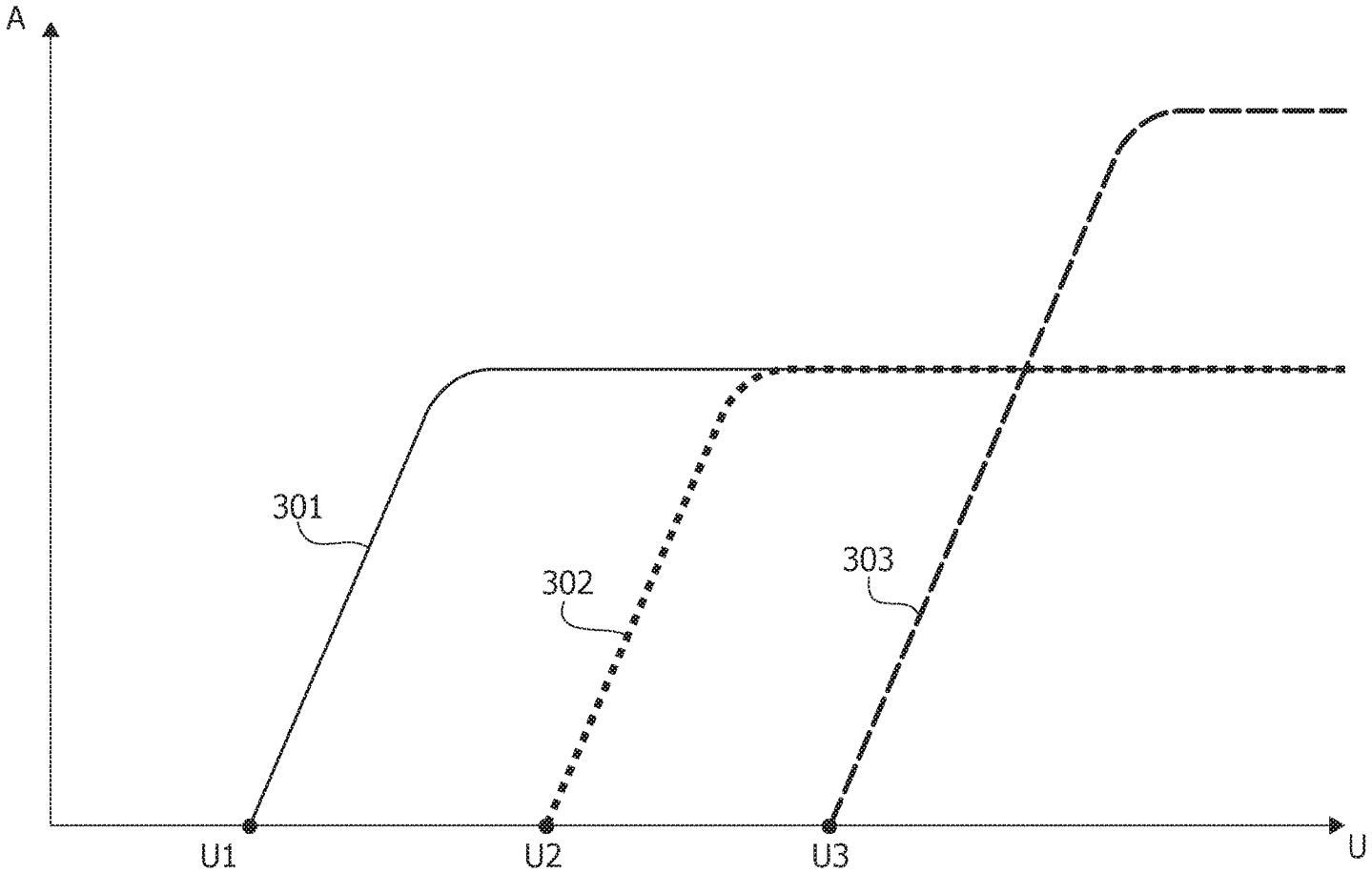

Further characteristics and advantages of the present invention shall emerge from the following description with respect to the enclosed drawings, provided merely as a nonlimiting example, where:

FIG. 1 is a diagram of a preferred embodiment of the cooling system according to the invention, and FIG. 2 is a diagram showing the various operating conditions of the electronically controlled distribution valve which is part of the cooling system according to the invention.

With regard to FIG. 1, reference number 1 generally indicates a cooling system for an internal combustion engine 2 of a motor vehicle.

The cooling system 1 comprises a circuit for a coolant of the engine, including a section of circuit 100 internal to the engine 2, and a section of circuit 101 external to the engine.

The section of circuit 101 external to the engine includes a first conduit 102 which feeds the coolant leaving the engine 2 to an electronically controlled distribution valve 3 of any known kind.

The distribution valve 3 has an inlet 300 which receives the coolant fed by the first conduit 102, a first outlet 301, a second outlet 302 and a third outlet 303.

In FIG. 1, the arrows along the connecting conduits of the hydraulic circuit indicate the direction of flow of the coolant.

The first outlet 301 of the distribution valve 3 communicates with a conduit 103 connected to the inlet 401 of a heat exchanger 4 of any known kind, which is used as a cooler of the engine lubricating oil. For this purpose, the heat exchanger 4 receives a flow of both the coolant coming from the conduit 103 and a flow of engine lubricating oil, which is fed from the engine 2 to the heat exchanger 4 through a conduit 104, and which returns from the heat exchanger 4 to the engine 2 through a conduit 105.

The coolant passing through the heat exchanger 4 emerges by an outlet 402 of the heat exchanger 4 to flow through a conduit 106 and a conduit 107 into a return conduit 108 which brings the coolant back to the engine 2.

In the return conduit 108 there is arranged a pump 5 serving to activate the circulation of the coolant in the circuit.

The pump 5 can be provided to be actuated by the shaft of the internal combustion engine 2 or it can be controlled by a respective electric motor, whose operation is controlled by an electronic control unit E.

Reference number 109 indicates a second conduit connecting the first conduit 102 to the conduit 103 communicating with the inlet 401 of the cooler 4 of the engine lubricating oil.

In the second conduit 109 there is arranged a thermally insulated tank 6, having an inlet 601 and an outlet 602. The tank 6 can be fabricated in any known manner. It is typically comprised of a container, such as one of cylindrical shape, having a thermally insulating wall. Check valves 603, 604 are installed in the conduit 109 upstream and downstream of the tank 7 to allow a flow in the conduit 109 solely in the direction of the conduit 103 connected to the inlet 401 of the heat exchanger 4 constituting the cooler of the engine lubricating oil. Reference 7 shows schematically a constricted cross-section disposed in the connection between the inlet 601 of the tank 6 and the conduit 102 feeding the coolant leaving the engine. In the system calibration phase, the constricted cross-section 7 is dimensioned so as to ensure that, when the distribution valve 3 is in an opened condition in which one or more of its outlets 301, 302, 303 communicate with the inlet 300, the coolant leaving the engine and flowing in the conduit 102 tends to continue toward one or more outlets of the valve 3 instead of flowing through the conduit 109. Vice versa, when the valve 7 is in the closed condition in which all three of its outlets 301, 302, 303 are isolated with respect to the inlet 300, the coolant coming from the conduit 102 is forced to flow through the conduit 109, through the thermally insulated tank 6 and the heat exchanger 4 making up the cooler of the engine lubricating oil.

Returning to the distribution valve 3, its second outlet 302 communicates with a conduit 110 connected to the inlet 801 of a heat exchanger 8 utilized as a heater of the conditioning air of the passenger compartment of the motor vehicle. An outlet 802 of the heat exchanger 8 communicates with a conduit 111 which takes the coolant leaving the heat exchanger 8 back to the engine 2, through the conduits 107, 108 and the pump 5.

A third outlet 303 of the valve 3 communicates with a conduit 112 connected to an inlet 901 of a radiator 9 of the motor vehicle. The outlet 902 of the radiator 9 is connected to a conduit 113 by which the coolant leaving the radiator 9 returns to the engine, through the conduit 108 and the pump 5.

The valve 3, finally, has a fourth outlet 304 connected to a conduit 114 which communicates with an expansion vessel 10, according to the conventional engineering. The expansion vessel 10 is provided, again in conventional manner, with a direct communication 1001 with the circuit of the coolant of the engine. In the conduit 114 there is disposed a check valve 1002 which allows a flow in the conduit 114 only in the direction of the expansion vessel 10.

The distribution valve 3 is of any known type able to be selectively switched to one of the following operating positions:

- a closed condition, in which all three outlets 301, 302, 303 are isolated from the inlet 300;
- a first open condition, in which only the first outlet 301 communicates with the inlet 300;
- a second open condition, in which only the two outlets 301, 302 communicate with the inlet 300; and
- a third open condition, in which all three outlets 301, 302, 303 communicate with the inlet 300.

The valve 3 is a solenoid valve and the switching to the various operating conditions is achieved by a progressive increase of the electrical power supply voltage of the solenoid. FIG. 2 is a diagram illustrating the various operating conditions of the valve 3 as a function of the electrical power supply voltage. In the diagram of FIG. 2, the degree of opening of each of the three outlets 301, 302, 303 of the valve 3 is represented in the form of a lift A of a movable element of the valve upon variation in the electrical power supply voltage U. Below a value U1, the valve 3 is in a completely closed condition. When the power supply voltage U exceeds the value U1, the first outlet 301 is progressively opened, until la condition of complete opening is reached. Above a voltage value U2, also in the second outlet 302 there is a progressive opening until a completely open condition is reached. Finally, also the third outlet 303 is opened progressively until reaching a completely open condition when the power supply voltage exceeds a third value U3.

The energizing of the solenoid of the distribution valve 3 is controlled by the electronic control unit E which may be the electronic control unit controlling the operation of the engine 2. As noted, the electronic control unit E can also provide control of the electric motor driving the pump 5, in the event that said pump is driven by an electric motor.

Furthermore, in the sample embodiment illustrated here, two temperature sensors 605, 606 are provided in the conduit 109, respectively upstream and downstream from the tank 6. The output signals of the temperature sensors 605, 606 are sent to the electronic control unit E.

According to a conventional technique, the cooling system furthermore comprises at least one sensor 11 of the temperature of the coolant leaving the engine.

According to the invention, the electronic control unit E is programmed so that, after a start of the internal combustion engine, a number of different operating phases are actuated in succession upon increasing of the temperature value of the coolant as detected by the sensor 11.

In a first phase, the electronically controlled distribution valve is maintained in its closed condition, so that the coolant leaving the engine 2 immediately after the start of the engine flows entirely from the conduit 102 to the conduit 109, causing the heat exchanger 4 to be fed with the quantity of relatively warm coolant previously stored in the thermally insulated tank 6. The tank 6 is typically able to maintain the temperature of the coolant stored in it at a value higher than the ambient temperature, even during prolonged stops of the motor-vehicle with the engine inactive. As noted above, when the engine is started, the coolant leaving the engine 2, still relatively cold, is taken entirely to the tank 6, which is therefore emptied of the warm coolant previously stored therein. The warm coolant stored in the tank 6 is therefore fed to the heat exchanger 4. In this phase, the heat exchanger functions as a heater of the lubricating oil and the quantity of warm liquid previously stored in the tank 6 makes it possible to accelerate the warm-up phase of the engine oil so as to reduce the time needed to bring the oil up to the ideal temperature in order to minimize engine frictions and, consequently, fuel consumption.

For example, in the case of a tank with a capacity of two liters, the aforesaid first phase in which the tank 6 is emptied of the warm liquid previously contained therein may have a duration on the order of 20 seconds. The electronic control unit E is programmed to compare the temperature values coming from the temperature sensors 605, 606. When the control unit detects that these temperature values are identical within a predetermined tolerance margin, it deduces that the entire quantity of relatively warm coolant previously stored in the tank 6 has left the tank. This condition is considered to be the conclusion of the first operating phase of the system.

At the end of this first operating phase, the electronic control unit E triggers switching of the valve 3 from the closed condition to the aforesaid first opened condition, in which only the first outlet 301 communicates with the inlet 300 of the valve. In this condition, as mentioned, basically the entire flow of the coolant leaving the engine 2 flows from the conduit 102 into the conduit 103. Therefore, the entire flow of the coolant leaving the engine, also in this second operating phase, is directed to the heat exchanger 4 which in this phase acts as a heater of the lubricating oil, so as to allow reaching the ideal operating temperature of the oil as quickly as possible. The reaching of the end of this second operating phase can be detected as an exceeding of a predetermined threshold value detected by the temperature sensor 11. However, it is also possible to provide a sensor of the lubricating oil temperature, and to design the electronic control unit E to receive the output signal of this lubricating oil temperature sensor and to consider the second operating phase to be concluded when the value detected for the lubricating oil temperature reaches a predetermined threshold value.

Whatever solution is chosen, once the conclusion of the second operating phase is detected the electronic control unit E triggers switching of the valve 3 to a second opened condition, in which only the outlets 301 and 302 communicate with the inlet 300. In this phase, therefore, a portion of the coolant coming from the conduit 102 continues to be fed to the heat exchanger 4, which will thus maintain the temperature of the engine lubricating oil at the desired value, as the engine warms-up, while another portion of the coolant flows in the conduit 110, to activate the heater 8 of the passenger compartment.

In a third operating phase, which can be initiated when the temperature value detected by the sensor 11 exceeds a second threshold value greater than the first threshold value, the valve 3 is switched to a third opened condition, in which all three outlets 301, 302, 303 communicate with the inlet 300. In this phase, the coolant of the engine is also fed to the radiator 9 of the motor vehicle, where it is cooled prior to returning to the engine 2.

As indicated above, the constricted cross-section 7 in the conduit 109 ensures that the coolant 102 is taken at least for the most part to the outlet 301 and/or to the outlet 302 and/or to the outlet 303, when the valve 3 is in one of its opened conditions. On the other hand, when the internal combustion engine 2 is switched-off, it is necessary to activate a phase in which the thermally insulated tank 6 is again refilled with coolant at elevated temperature. To accomplish this result, the electronic control unit E is designed to receive a signal indicative of a switch-off command of the engine and consequently to switch the valve 3 to its closed condition, so as to direct the entire flow of the coolant leaving the engine to the tank 6. Once again, the electronic control unit E will be able to detect the complete filling of the tank 6 with warm coolant, by checking that the temperature values detected by the sensors 605, 606 are substantially identical. Once reaching of this condition is detected, the electronic control unit E can enable the actual shutdown of the engine.

In the event that the pump 5 is driven by an electric motor associated therewith, the phase of filling the tank 6 with warm coolant can be activated even after the actual shutdown of the engine, since even when the engine is shut down the electronic control unit E can trigger the activation of the electric motor driving the pump 5. However, in the case where the pump is controlled by the engine 2, it is necessary to carry out the phase of filling the tank 6 with warm liquid before the engine is actually shut down.

The provision of the constricted cross-section 7 in the conduit 109 enables a proper operation of the system without the need to provide the complication of an intercepting valve in the conduit 109. On the other hand, the same result can be achieved by arranging, in place of the constricted cross-section 7 in the conduit 109, a labyrinth pathway (not shown). In this case, the labyrinth pathway can be comprised, for example, of a tubing arranged in a winding course directly around the wall of the tank 6, on its outside.

Reverting to the distribution valve 3, the communication of this valve with the conduit 114 connected to the expansion vessel 10 is controlled in a conventional manner, by an on/off element sensitive to a pressure difference.

Naturally, while the principle of the invention remains the same, the details of construction and the embodiments may widely vary with respect to what has been described and illustrated, merely as an example, without thereby departing from the scope of the present invention.

What is claimed is:

1. A cooling system for a motor-vehicle internal combustion engine, said cooling system comprising:

a cooling circuit for an engine coolant, including an inner circuit portion internal to the engine and an outer circuit portion external to the engine, a thermally insulated tank for the coolant, connected to said outer portion of the cooling circuit and adapted to maintain a determined quantity of coolant at a temperature higher than an ambient temperature when the engine is inactive, so as to enable said determined quantity of coolant at the temperature higher than ambient temperature to be used after a subsequent start of the engine, during an engine warm-up stage, said outer circuit portion further including:

a pump to activate circulation of the coolant in the cooling circuit, a lubricating oil cooler for cooling lubricating oil of the engine, a heater for heating a passenger compartment of the motor-vehicle, a radiator for cooling the coolant, an electronically controlled distribution valve configured to control flow of coolant in the outer circuit portion, so as to direct this flow towards the lubricating oil cooler and/or towards the passenger compartment heater and/or towards the radiator, and an electronic control unit configured to control an operating condition of said electronically controlled distribution valve as a function of one or more operating parameters including at least one detected value of the coolant temperature, wherein said electronically controlled distribution valve has an inlet connected to a first conduit supplying coolant coming out from the engine, wherein said thermally insulated tank is placed in a second conduit connecting said first conduit to an inlet of said lubricating oil cooler, wherein said electronically controlled distribution valve comprises:

a first outlet connected to an inlet of the lubricating oil cooler, a second outlet connected to an inlet of said passenger compartment heater, and a third outlet connected to an inlet of said radiator, said electronically controlled distribution valve being selectively switchable to one of the following operating conditions:

a closed condition, in which all of said first, second and third outlets are isolated with respect to said inlet of the electronically controlled distribution valve, a first opened condition, in which only said first outlet communicates with the inlet of the electronically controlled distribution valve, a second opened condition, in which only said first and second outlets communicate with the inlet of the electronically controlled distribution valve, and a third opened condition, in which all said first, second and third outlets communicate with said inlet of the electronically controlled distribution valve, said electronic control unit being configured so that, after the engine is started, the following operating phases are actuated in sequence, as a detected temperature of the coolant increases:

a first stage in which the electronically controlled distribution valve is maintained in its closed condition, so that coolant leaving the engine flows entirely from said first conduit to said second conduit, causing the determined quantity of coolant previously stored within the thermally insulated tank to be fed to the lubricating oil cooler, a second stage in which the electronically controlled distribution valve is maintained in its first opened condition, so that the coolant leaving the engine is still fed solely to the lubricating oil cooler, a third stage in which the electronically controlled distribution valve is maintained in its second opened condition, so that the coolant leaving the engine is fed both to the lubricating oil cooler and to the passenger compartment heater, and a fourth stage in which the electronically controlled distribution valve is maintained in its third opened condition, so that the coolant leaving the engine is fed to the lubricating oil cooler and to the passenger compartment heater and to the radiator.

2. The cooling system according to claim 1, wherein an inlet of said thermally insulated tank communicates with said first conduit through a passage with a restricted cross-section and/or through a labyrinth path, so that when the electronically controlled distribution valve is in one of its opened conditions the coolant leaving the engine flows toward the outlets of the electronically controlled distribution valve, rather than towards said thermally insulated tank.

3. The cooling system according to claim 2, wherein the inlet of the thermally insulated tank communicates with the first conduit through a labyrinth path defined by a conduit arranged in a winding path around a body of the thermally insulated tank.

4. The cooling system according to claim 1, wherein two temperature sensors are provided in said second conduit, respectively arranged upstream and downstream of the thermally insulated tank, and the electronic control unit is configured to receive output signals from said temperature sensors and to cause a switching from said first operating stage to said second operating stage when temperature values detected by said temperature sensors become substantially the same.

5. The cooling system according to claim 1, wherein said electronic control unit is configured to cause a switching from said second operating stage to said third operating stage when said detected value of coolant temperature exceeds a first threshold value, and to cause a switching from said third operating stage to said fourth operating stage when the detected value of coolant temperature exceeds a second threshold value, greater than said first threshold value.

6. The cooling system according to claim 1, wherein the electronic control unit is configured to receive a signal indicative of an engine switch-off command to switch-off the engine, as well as to consequently cause switching of the electronically controlled distribution valve to its closed condition, so that warm coolant leaving the engine is directed to said thermally insulated tank.

7. The cooling system according to claim 6, wherein the pump is actuated by the engine and said electronic control unit is configured to enable switch-off of the engine only after detecting a filling of the thermally insulated tank with the warm coolant leaving the engine.

8. The cooling system according to claim 6, wherein the pump is actuated electrically, and switching of the valve to the closed condition to obtain filling of the thermally insulated tank with warm coolant is triggered after the engine has been switched-off.

9. A method for controlling a cooling system of an internal combustion engine of a motor-vehicle, wherein said cooling system comprises:

a cooling circuit for an engine coolant, including an inner circuit portion internal to the engine and an outer circuit portion external to the engine, a thermally insulated tank for the coolant, connected to said outer portion of the cooling circuit and able to maintain a determined quantity of coolant at a temperature higher than an ambient temperature when the engine is inactive, to allow the use of such determined quantity of coolant at the temperature higher than ambient temperature after a subsequent starting of the engine, during an engine warm-up phase, said outer circuit portion further including:

a pump to activate the circulation of the coolant in the cooling circuit, a lubricating oil cooler for cooling lubricating oil of the engine, a heater for heating a passenger compartment of the motor-vehicle, a radiator for cooling the coolant, an electronically controlled distribution valve configured to control flow of coolant in the outer circuit portion, so as to direct this flow towards the lubricating oil cooler and/or towards the passenger compartment heater and/or towards the radiator, and an operating condition of said electronically controlled distribution valve being controlled as a function of one or more operating parameters, including at least one detected value of coolant temperature, wherein said electronically controlled distribution valve has an inlet connected to a first conduit supplying coolant coming out from the engine, wherein said thermally insulated tank is placed in a second conduit connecting said first conduit to an inlet of said lubricating oil cooler, wherein said electronically controlled distribution valve comprises:

a first outlet connected to an inlet of the lubricating oil cooler, a second outlet connected to an inlet of said passenger compartment heater, and a third outlet connected to an inlet of said radiator, wherein said electronically controlled distribution valve is selectively switchable to one of the following operating conditions:

a closed condition, in which all of said first, second and third outlets are isolated with respect to said inlet of the electronically controlled distribution valve, a first opened condition, in which only said first outlet communicates with the inlet of the electronically controlled distribution valve, a second opened condition, in which only said first and second outlets communicate with the inlet of the electronically controlled distribution valve, and a third opened condition, in which all said first, second and third outlets communicate with said inlet of the electronically controlled distribution valve, the method comprising, after the engine is started, actuating the following operating phases in succession, as a detected temperature of the coolant increases:

a first phase in which the electronically controlled distribution valve is maintained in its closed condition, so that coolant leaving the engine flows entirely from said first conduit to said second conduit, causing the determined quantity of coolant previously stored within the thermally insulated tank to be fed to the lubricating oil cooler, a second phase in which the electronically controlled distribution valve is maintained in its first opened condition, so that the coolant leaving the engine is still fed solely to the lubricating oil cooler, a third phase in which the electronically controlled distribution valve is maintained in its second opened condition, so that the coolant leaving the engine is fed both to the lubricating oil cooler and to the passenger compartment heater, and a fourth phase in which the electronically controlled distribution valve is maintained in its third opened condition, so that the coolant leaving the engine is fed to the lubricating oil cooler and to the passenger compartment heater and to the radiator.

10. The method according to claim 9, wherein two temperature sensors are provided in said second conduit, respectively arranged upstream and downstream from the thermally insulated tank, and a switching from said first operating phase to said second operating phase is triggered when temperature values detected by said temperature sensors become substantially identical.

11. The method according to claim 9, wherein said electronic control unit is configured to cause switching from said second operating phase to said third operating phase when said detected value of coolant temperature exceeds a first threshold value, and to cause switching from said third operating stage to said fourth operating stage when the detected value of coolant temperature exceeds a second threshold value, greater than said first threshold value.

12. The method according to claim 9, wherein when a command to switch-off the engine is received, warm coolant leaving the internal combustion engine is taken to said thermally insulated tank.

13. The method according to claim 12, wherein the pump is actuated by the engine and switch-off of the engine is enabled only after having detecting filling of the thermally insulated tank with warm coolant leaving the engine.

14. The method according to claim 12, wherein the pump is actuated electrically and the thermally insulated tank is filled with warm coolant after the engine has been switched-off.

* * * * *